US008338732B2

(12) United States Patent
Staffas et al.

(10) Patent No.: US 8,338,732 B2
(45) Date of Patent: Dec. 25, 2012

(54) SPRING OPERATED ACTUATOR FOR AN ELECTRICAL SWITCHING APPARATUS

(75) Inventors: Daniel Staffas, Ludvika (SE); Johannes Tredoux, Ludvika (SE); Mats Holman, Ludvika (SE); Ulf Åkesson, Ludvika (SE)

(73) Assignee: ABB Technology AG (CH)

( * ) Notice: Subject to any disclaimer, the term of this patent is extended or adjusted under 35 U.S.C. 154(b) by 0 days.

(21) Appl. No.: 13/458,350

(22) Filed: Apr. 27, 2012

(65) Prior Publication Data

US 2012/0211341 A1 Aug. 23, 2012

Related U.S. Application Data

(63) Continuation of application No. PCT/EP2010/066385, filed on Oct. 28, 2010.

(30) Foreign Application Priority Data

Nov. 3, 2009 (EP) ..... 09174942

(51) Int. Cl.
*H01H 33/42* (2006.01)

(52) U.S. Cl. ..... 200/400; 218/154

(58) Field of Classification Search ..... 200/400, 200/401, 500, 501; 218/7, 14, 78, 120, 140, 218/153, 154; 74/2; 185/2, 9–11, 37, 39, 185/40, 40 B, 45; 267/154, 155, 157, 166, 267/168

See application file for complete search history.

(56) References Cited

U.S. PATENT DOCUMENTS

| | | | | |
|---|---|---|---|---|
| 4,256,941 | A * | 3/1981 | Bachler | 200/400 |
| 4,678,877 | A | 7/1987 | Nicoloso | |
| 5,280,258 | A | 1/1994 | Opperthauser | |
| 5,486,667 | A * | 1/1996 | Castonguay et al. | 200/400 |
| 5,504,289 | A * | 4/1996 | Smith et al. | 200/400 |
| 5,571,255 | A | 11/1996 | Baginski et al. | |
| 5,777,404 | A | 7/1998 | Has | |
| 6,232,569 | B1 * | 5/2001 | Nakajima et al. | 200/400 |
| 6,337,449 | B1 * | 1/2002 | Brouillat et al. | 200/400 |
| 6,444,934 | B1 | 9/2002 | Imura et al. | |
| 6,667,452 | B2 | 12/2003 | Spiegel | |
| 2002/0056631 | A1 * | 5/2002 | Ohtsuka et al. | 200/400 |
| 2002/0100675 | A1 * | 8/2002 | Imura et al. | 200/400 |

FOREIGN PATENT DOCUMENTS

| | | | |
|---|---|---|---|
| DE | 102008026798 | B3 | 7/2009 |
| EP | 0110082 | A2 | 6/1984 |
| EP | 186171 | A * | 7/1986 |

OTHER PUBLICATIONS

European Search Report; Application No. EP 09 17 4942; Issued: Mar. 30, 2010; Mailing Date: Apr. 22, 2010; 4 pages.

International Search Report & Written Opinion of the International Searching Authority; Application No. PCT/EP2010/066385; Issued: Jan. 25, 2011; Mailing Date: Jan. 31, 2011; 7 pages.

* cited by examiner

*Primary Examiner* — Michael Friedhofer
(74) *Attorney, Agent, or Firm* — St. Onge Steward Johnston & Reens LLC

(57) ABSTRACT

A spring operated actuator for an electrical switching apparatus. It has an opening spring and a closing spring, one of them including a torsion spring. The torsion spring is charged in the unwinding direction and discharged in the winding direction.

15 Claims, 9 Drawing Sheets

SPRING OPERATED ACTUATOR FOR AN ELECTRICAL SWITCHING APPARATUS

CROSS-REFERENCE TO RELATED APPLICATIONS

The present application is a continuation of pending International patent application PCT/EP2010/066385 filed on Oct. 28, 2010 which designates the United States and claims priority from European patent application 09174942.4 filed on Nov. 3, 2009. The content of all prior applications is incorporated herein by reference.

FIELD OF THE INVENTION

The present invention relates to a spring operated actuator for an electrical switching apparatus, the spring operated actuator including closing spring means for closing the switching apparatus and opening spring means for opening the switching apparatus, at least one of said spring means including a torsion spring defining a winding direction and an unwinding direction thereof and being arranged to be charged with, to store and to discharge mechanical energy.

BACKGROUND OF THE INVENTION

In a power transmission or distribution network, switching apparatuses are incorporated into the network to provide automatic protection in response to abnormal load conditions or to permit opening or closing (switching) of sections of the network. The switching apparatus may therefore be called upon to perform a number of different operations such as interruption of terminal faults or short line faults, interruption of small inductive currents, interruption of capacitive currents, out-of-phase switching or no-load switching, all of which operations are well known to a person skilled in the art.

In switching apparatuses the actual opening or closing operation is carried out by two contacts where normally one is stationary and the other is mobile. The mobile contact is operated by an operating device which comprises an actuator and a mechanism, where said mechanism operatively connects the actuator to the mobile contact.

Actuators of known operating devices for medium and high voltage switches and circuit breakers are of the spring operated, the hydraulic or the electromagnetic type. In the following, operating devices will be described operating a circuit breaker, but similar known operating devices may also operate switches.

A spring operated actuator, or spring drive unit as it is also called generally, uses two springs for operating the circuit breaker, an opening spring for opening the circuit breaker and a closing spring for closing the circuit breaker and reloading the opening spring. Instead of just one spring for each one of the opening spring and the closing spring, sometimes a set of springs may be used for each one of the opening spring and the closing spring. For example, such a set of springs may include a small spring arranged inside a larger spring or two springs arranged in parallel, side by side. In the following, it should be understood that when reference is made to the spring of the respective opening spring and the closing spring, such a spring could include a set of springs. Another mechanism converts the motion of the springs into a translation movement of the mobile contact. In its closed position in a network, the mobile contact and the stationary contact of the circuit breaker are in contact with each other and opening spring and the closing spring of the operating device are charged. Upon an opening command the opening spring opens the circuit breaker, separating the contacts. Upon a closing command the closing spring closes the circuit breaker and, at the same time, charges the opening spring. The opening spring is now ready to perform a second opening operation if necessary. When the closing spring has closed the circuit breaker, the electrical motor in the operating device recharges the closing spring. This recharging operation takes several seconds.

Illustrative examples of spring operated actuators for a circuit breaker can be found e.g. in U.S. Pat. No. 4,678,877, U.S. Pat. No. 5,280,258, U.S. Pat. No. 5,571,255, U.S. Pat. No. 6,444,934 and U.S. Pat. No. 6,667,452.

In known spring operated actuators, axially acting springs, i.e. compression or tension helical springs, are used. Also, torsion springs such as torsion bars, helical springs and clock springs are used for the actuation of the opening and closing movements.

The use of torsion springs such as helical springs and clock springs requires that the ends of such a spring has to be securely connected to a support, e.g. a frame, and to the drive connection, e.g. main a drive shaft, respectively. This mounting is critical to the function of the actuator since it must withstand a sudden high actuation force and transfer the force to the actuator.

The term "end" related to a helical torsion spring is in this application meant the end of the spring material, i.e. the end in the direction of the spring helix. For the ends in the axial direction the term "axial end" is used.

SUMMARY OF THE INVENTION

The object of the present invention is to provide a spring operated actuator with an improved connection of a torsion spring to the components with which it co-operates.

This object is according to the invention achieved in that a spring operated actuator of the kind initially specified includes the specific features that in at least one of said spring means said torsion spring is arranged to be charged with mechanical energy in the unwinding direction and to discharge the mechanical energy in the winding direction.

This means that the torsion spring is compressed in the direction of the spiral of the spring when it stores the energy, and the ends of the spring act by pushing instead of pulling as in a conventional helical torsion spring. The connection of the spring ends to the support and to the drive shaft thereby becomes less complicated in comparison with a mounting under tension instead of pressure.

Since the spring ends act by a pressure force on the components with which the torsion spring co-operate, the spring end and the component in question are held together by this force without any further connection means, except for possibly some kind of guiding device keeping them laterally in place. This substantially simplifies the mounting in comparison with a torsion spring operating by tension, in which case strong and reliable connection means are required.

Thereby the assembly of the device becomes much simpler, and fewer components are required. Further a potential source of malfunction is eliminated. A device according to the present invention therefore becomes cheaper in manufacture and maintenance and also more reliable.

According to a preferred embodiment both the opening spring means and the closing spring means includes a torsion spring.

The use of torsion springs for the actuation allows a compact construction of the actuator and in particular this is the case when both the springs are torsion springs.

When both the springs are of the torsion type, preferably both of them are arranged to be charged in the unwinding direction and discharged in the winding direction.

Thereby the advantage of this arrangement is made use of to its full extent.

According to a further preferred embodiment, at least one of the torsion springs is a helical spring.

A helical spring in most cases is the most efficient type for storing and supplying mechanical energy in applications as in the present invention. In comparison e.g. to a clock spring the helical spring provides a larger freedom for an optimal relative location of the springs.

According to a further preferred embodiment, the torsion springs are coaxial.

The two axially aligned torsion springs make it possible to obtain a compact construction of the actuator, and the number of components required to transmit the spring forces to the main drive shaft can be reduced in relation to conventional constructions.

According to a further preferred embodiment, the torsion springs are arranged one outside the other and such that at least a major part of the opening torsion spring and at least a major part of the closing spring have the same axial location.

This provides a very compact arrangement of the torsion springs which contributes further to achieve an actuator of small dimensions. Preferably the entire opening torsion spring and the entire closing torsion spring have the same axial location, since that will be the optimal arrangement with respect to space-saving.

Preferably, the opening torsion spring is located outside the closing torsion spring.

This facilitates charging of the torsion springs where the opening torsion spring is recharged by the closing torsion spring and the latter is charged by an electrical motor or manually. Since the opening torsion spring normally operates at higher speed than the closing spring means it is a further advantage that this arrangement make it simple to provide that the opening torsion spring acts on the drive shaft at a larger radius than the closing torsion spring.

According to a further preferred embodiment, the opening torsion spring and the closing torsion spring each is a helical spring with an end portion at each end of the respective spring whereby at least one of said end portions extend along the helix of the spring.

When the end portion thus extends in the same direction as the rest of the spring the force transmission will be very simple and there will be no bending forces in the spring material. Preferably all the end portions are of this kind.

According to a further preferred embodiment, at least one end portion extends into an end fitting having an abutment surface arranged in abutting relationship with an end surface of said at least one end portion.

Such an end fitting provides an advantageous force transfer between the spring and the parts with which it cooperates.

Preferably, the end surface and the abutment surface are perpendicular to the helix of the spring.

This optimizes the force transfer since any lateral force component is avoided, and makes the connections as simple as possible.

According to a further preferred embodiment the end fitting includes a holding device arranged to hold the end portion directed to the abutment surface.

Thereby a proper alignment of the abutment surface and the end surface is assured.

Preferably, the holding device includes a radially directed flange, with a hole through which the end portion extends.

This embodiment represents a very simple realisation of directing the end portion towards the abutment surface.

According to a further preferred embodiment the closing torsion spring includes a first torsion spring unit and a second torsion spring unit, which first and second units are coaxial, at least a major portion of the first unit and a major portion of the second unit have the same axial location, the first unit is located radially outside the second unit and the first and second units are connected to each other adjacent one axial end of the closing torsion spring.

Through this embodiment the closing torsion spring has both its end, i.e. the frame supported end and the active end, adjacent one and the same axial end of the torsion spring. This further contributes to allow a compact design, a short axial extension of the closing spring and a low amount of components. It is preferred that the entire first unit and the entire second unit have the same axial location, since that minimizes the axial length of the closing spring and simplifies the actuation.

Although the two units can be made up by one single component, it is preferred that the two units are two separate components that are joined together by a spring force transmitting connection fitting. This simplifies the manufacturing of a closing torsion spring of this kind.

According to a further preferred embodiment the connection fitting includes a first abutment surface arranged in abutting relationship with an end surface of the first unit and a second abutment surface arranged in abutting relationship with an end surface of the second unit, which first and second abutment surfaces face in the opposite circumferential direction relative to each other.

Such an end fitting provides an efficient force transfer of the compression force from one of the units to the other.

Preferably, the connection fitting includes a holding device arranged to hold an end portion of each unit directed to a respective of said abutment surfaces.

This has corresponding advantages as described above for the end fitting having similar construction.

According to a further preferred embodiment, the connection fitting includes a first and second flange extending radially in relation to the spring axis, each flange having the abutment surface for one of the end portions and having a hole for holding the other one of the end portions directed to its abutment surface.

This construction of the connection fitting combines simplicity with reliability.

According to a further preferred embodiment, the electrical switching apparatus is a circuit breaker for medium or high voltage.

A circuit breaker is the most important application for the present invention and the advantages of the invention are particularly useful in the medium and high voltage range.

By medium voltage is conventionally meant a voltage level in the range of 1-72 kV and by high voltage is meant a voltage level above 72 kV, and these expressions have this meaning in the present application.

The invention also relates to an electric switching apparatus that includes a spring operated actuator according to the present invention, in particular to any of the preferred embodiments thereof. Preferably the switching apparatus is a circuit breaker and preferably the switching apparatus is a medium or high voltage switching apparatus.

The invented switching apparatus has corresponding advantages as those of the invented spring operated actuator and the preferred embodiments thereof, which advantages have been described above.

Preferred embodiments of the invention are disclosed herein. It is to be understood that further preferred embodiments of course can be realized by any possible combination of preferred embodiments mentioned above. The invention will be further explained through the following detailed description of an illustrative example thereof and with reference to the accompanying drawings.

DETAILED DESCRIPTION OF THE INVENTION

Figure 1:
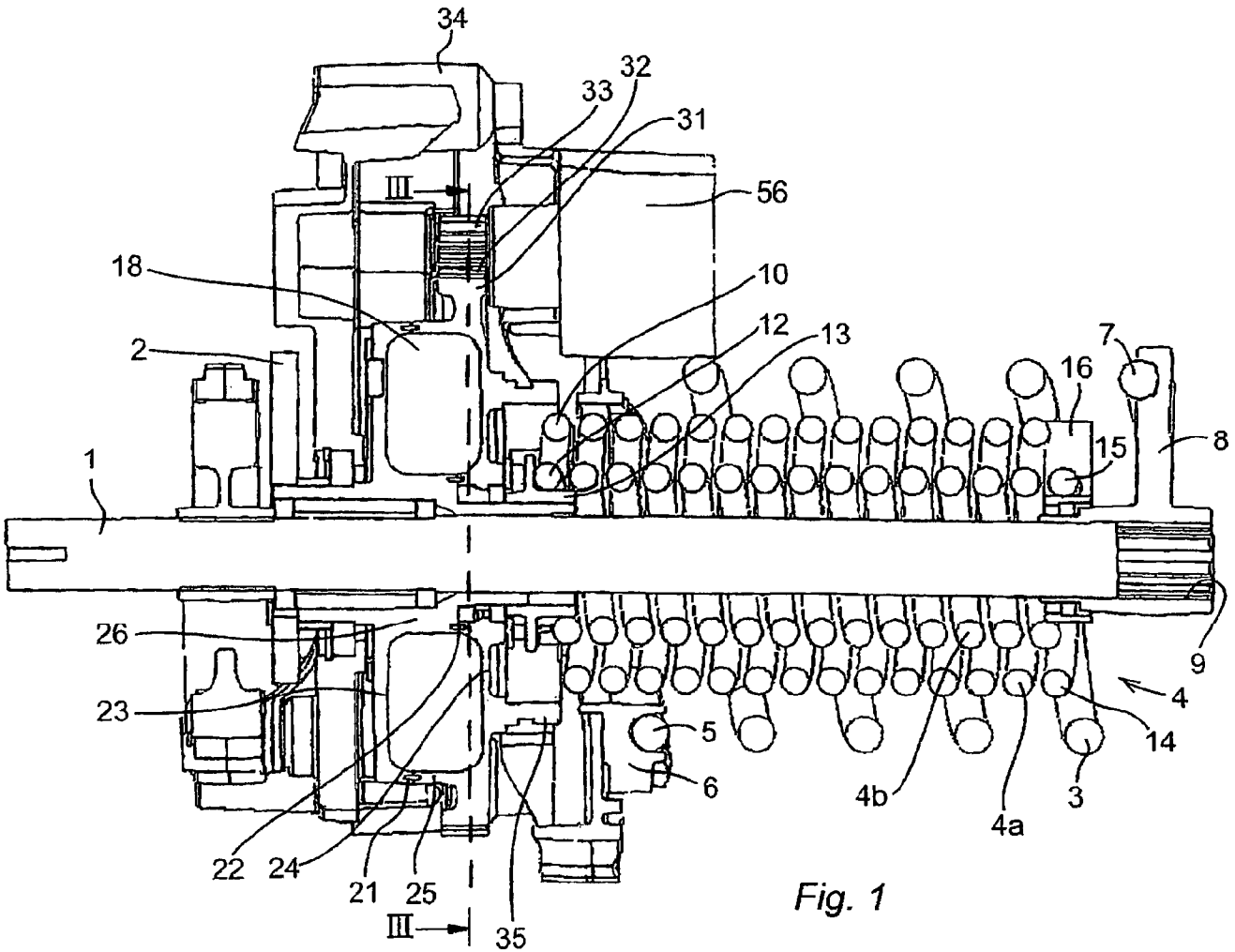
FIG. 1 is an axial section through an example of a spring operated actuator according to the invention.

FIG. 1 is an axial section through the actuator of a circuit breaker. The actuator has a main shaft 1 and a cam disc 2. The cam disc acts on the transmission rod (not shown) for switching the circuit breaker. The transmission from the cam disc to the circuit breaker and the circuit breaker as such can be of a conventional kind and need no further explanation.

The main shaft is operated by an opening spring 3 and a closing spring 4. Both the springs are helical torsion springs and are coaxial with the main shaft. The opening spring 3 is located radially outside the closing spring 4 and thus has an internal diameter exceeding the external diameter of the closing spring 4.

The opening spring 3 is squeezed between two end fittings, a supporting end fitting 6 at the supported end 5 of the spring and an actuating end fitting 8 at its actuating end 7. The opening spring 3 thus in its charged state is compressed in the direction of its helix, or otherwise expressed the charged opening spring is pressed in its unwinding direction. As a consequence the actuating end 7 is acting with a pushing force on the actuating end fitting 8, which is connected through splines 9 to the main shaft 1.

The closing spring 4 consists of two units, a radially outer unit 4*a* and a radially inner unit 4*b*, which both have axes aligned with the axis of the opening spring 3 and with the main shaft 1.

Like the opening spring also the closing spring 4 in its charged state is compressed in the direction of its helix. The outer unit 4*a* of the closing spring has a supported end 10 and a connection end 14, and the inner part has an actuating end 12 and a connection end 15. The supported end 10 is pressed against a supporting end fitting (not shown) which is mounted on a support flange 35, and the actuating end 12 is pressed against an actuating end fitting 13. The connection ends 14, 15 of the two units 4*a*, 4*b* are both pressed against a connection fitting 16, through which the two units are in force transmitting in relation to each other.

When the circuit breaker is trigged for an opening action the opening spring 3 pushes its actuation end fitting 8 to rotate and thereby rotate the main shaft 1.

Some 0.3 seconds later the circuit breaker is to be closed. The closing spring 4 thereby is activated such that the actuating end 12 thereof pushes its actuating end fitting 13 to rotate the main shaft 1 in a direction opposite to that of the opening process to move the actuation rod, thereby closing the circuit breaker. When the main shaft 1 rotates in this direction it will also rotate the actuating end fitting 8 of the opening spring 3 in the same direction such that it pushes the actuating end 7 of the opening spring 3 and the opening spring becomes recharged and prepared for a consecutive opening movement should that be required.

When the closing operation is finished the closing spring is recharged in that its supported end 10 is pushed by its supporting end fitting.

At the ends of the opening and closing movements the movements have to be damped in order to avoid impact shocks at the end of the strokes due to excess of energy.

The opening movement is damped by a conventional linearly acting hydraulic damper 17.

The closing movement is damped by a rotary damper 18 having air as working medium. The rotary damper 18 has a toroidal working chamber, that is coaxial with the main shaft 1. The working chamber is formed by a housing having a first side wall 24, a second side wall 23, an outer circumferential wall 25 and an inner circumferential wall 26. The housing is spitted into two parts, a first part 20 and a second part 19. The two parts are rotatable relative to each other and are connected by an outer circumferential seal 21 and an inner circumferential seal 22.

The second part 19 is drivingly connected to the actuating end fitting 13 of the inner unit 4*b* of the closing spring 4 and thus rotates together with the cam disc 2 at closing. The first part 20 on its outside has an axially extending flange 35 on which the supporting end fitting 11 of the outer unit 4*a* of the closing spring 4 is mounted.

Figure 3:
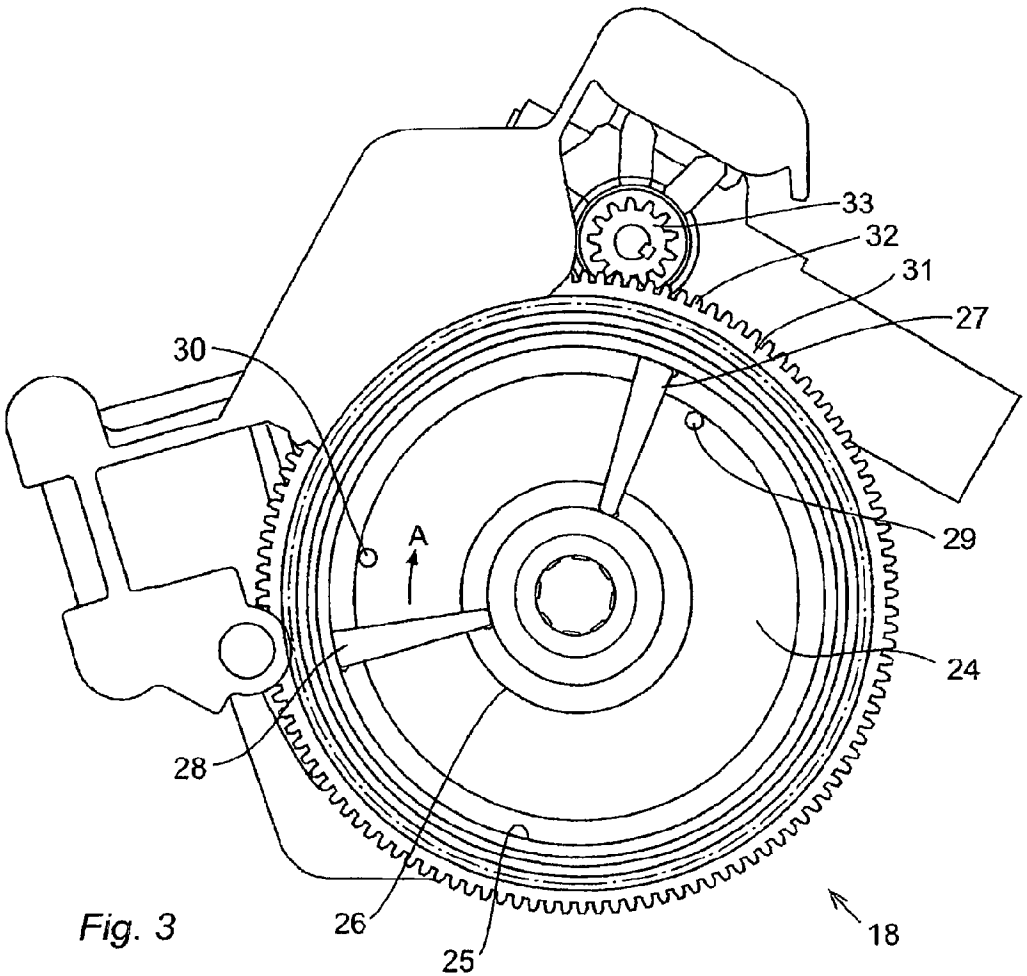
FIG. 3 is a section along line III-III in FIG. 1.

The operation of the closing damper is explained with reference to FIG. 3 which is a radial section through the damper in the direction towards the first part 20. During the closing movement the first part 20 is stationary and the second part 19 (not visible in FIG. 3) is rotating in direction of arrow A, defined as the rotational direction of the damper.

A disc-like body is attached to the first side wall 24, which forms a radial end wall 27. A corresponding disc-like body is attached to the second side wall 23 and forms a displacement body 28. Each of the end wall 27 and the displacement body 28 are sealingly cooperating with the side walls 23, 24 and the circumferential walls 25, 26 of the working chamber.

The first side wall has a first 29 and second 30 orifice there through to act as inlet and outlet respectively for air.

The inlet orifice 29 is located short after the end wall 27 as seen in the rotational direction of the damper. The outlet orifice 30 is located about a right angle ahead of the end wall 27.

When the closing spring is charged and in condition for initiating a closing movement the displacement body 28 is located closed to the end wall 27 on its right side as seen in the figure, i.e. in the area of the inlet orifice 29. The second part 19 of the housing is drivingly connected with the main shaft.

When a closing movement occurs the displacement body 28 will move from its initial position adjacent the end wall 27 since it is connected to the second side wall 23, and rotate in the direction of arrow A until it has made an almost complete turn and reaches the left side of the end wall 27. During its rotation air will be sucked in through the inlet orifice 29. And during the major part of the turn air will be pressed out through the outlet orifice 30.

After the displacement body has passed the outlet orifice 30 air will be trapped between the displacement body 28 and the end wall 27. Further rotation will compress the trapped air. Thereby an increasing counterforce against the rotation develops and some air leakage will occur along the sealing lines between the end wall 27 and the walls of the housing and between the displacement body 28 and the walls. Thereby the damping effect is achieved.

Normally the air leakage around the end wall and the displacement body is sufficient to attain a damping that is properly balanced between overdamping and underdamping. In case the seals are very effective a proper air leakage can be attained by providing a small leakage hole through the end wall 27 or through the displacement body 28.

Figure 4:
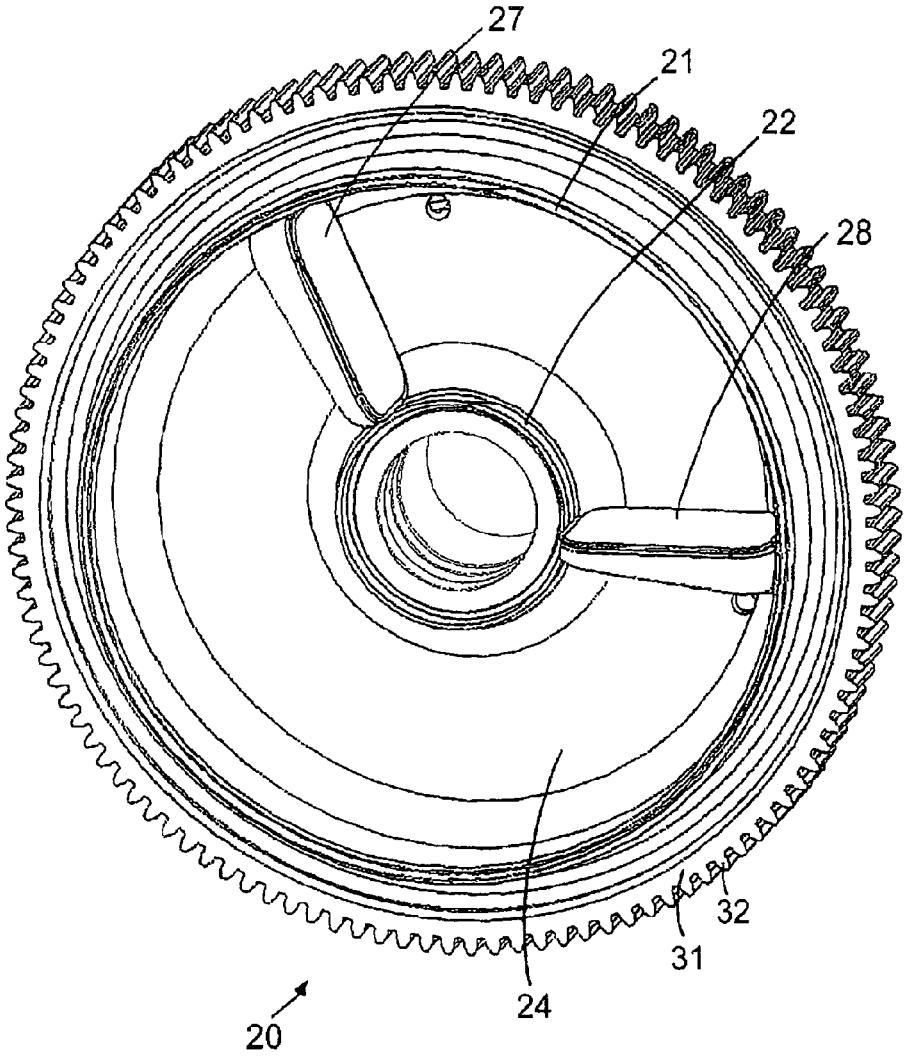
FIG. 4 is a perspective view of a detail of FIG. 3.

FIG. 4 is a perspective view of the first part of the housing of the closing damper.

The mechanism for charging the closing spring 4 is partly integrated with the closing damper 18. The first part 20 of the damper is externally shaped as a gear wheel 31 with external radially projecting teeth 32. The gear wheel 31 cooperates with a pinion 33 driven by an electric motor 34 via a gear box 56. At charging, the pinion 33 drives the first part 20 of the damper 18 in the direction of arrow A (FIG. 3) about one complete turn. The end wall 27 thereby moves to a position immediately to the left of the displacement body 28. The end wall 27 and the displacement body thus will reach a position relative to each other as described above when the closing movement starts.

Figure 2:
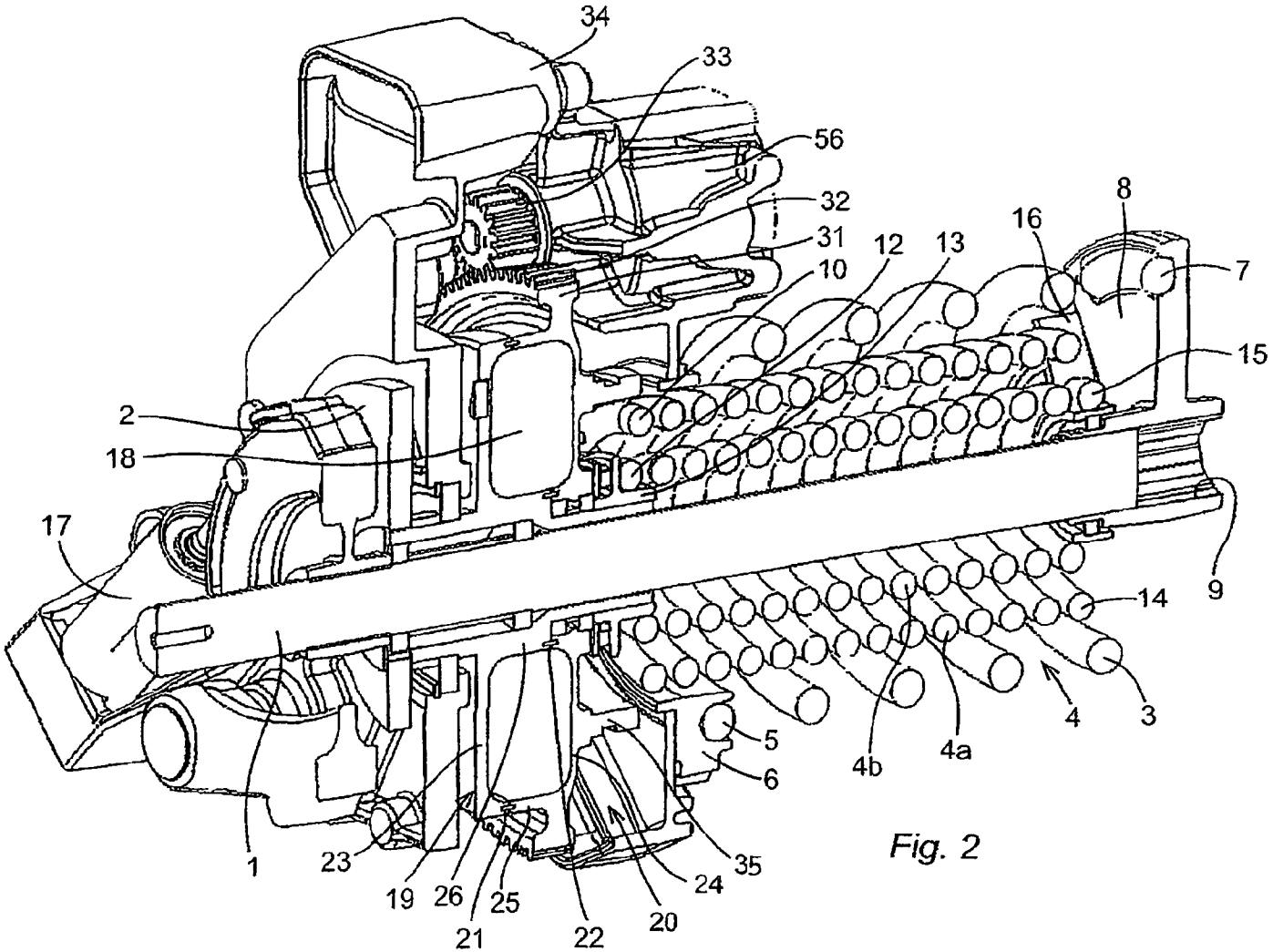
FIG. 2 is a perspective view of the section of FIG. 1.

The first part 20 of the damper 18 is through the flange 35 (FIGS. 1 and 2) drivingly connected to the supporting end fitting of the outer unit 4*a* of the closing spring 4.

When the first part 20 rotates, the supporting end fitting of the outer unit 4*a* of the closing spring will follow its rotation since it is mounted on the axial flange 35 extending rearwards from the first part 20 of the damper 18. Thereby the closing spring is helically compressed to its charged state.

Figure 5:
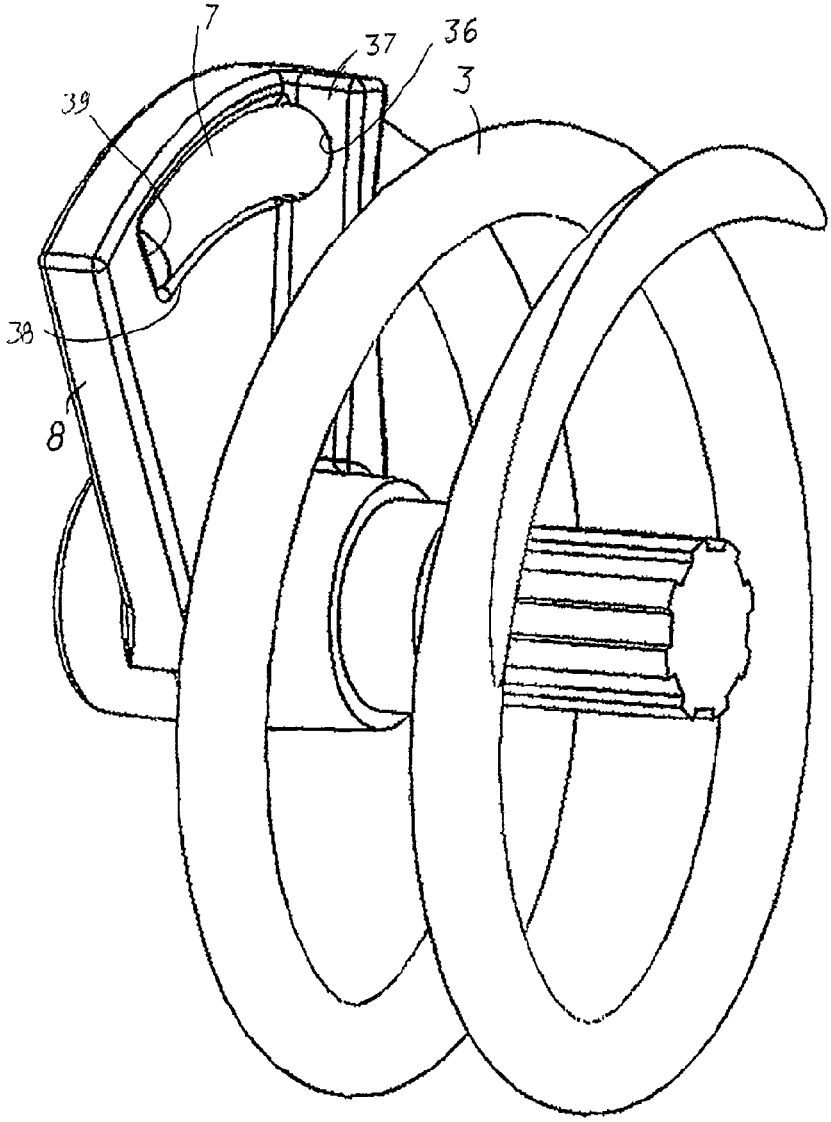
FIG. 5 is a perspective view of a detail of the spring operated actuator of FIG. 1-4.

FIG. 5 is a perspective view of the end fitting 8 of the spring 3 as seen from the spring towards the end fitting. The actuating end 7 of the opening spring 3 extends through a hole 36 in a flange 37 forming a part of the end fitting 8. A groove 38 in the end fitting 8 guides the actuating end 7 against an abutment surface 39. The other end fittings may have a similar construction.

Figure 6:
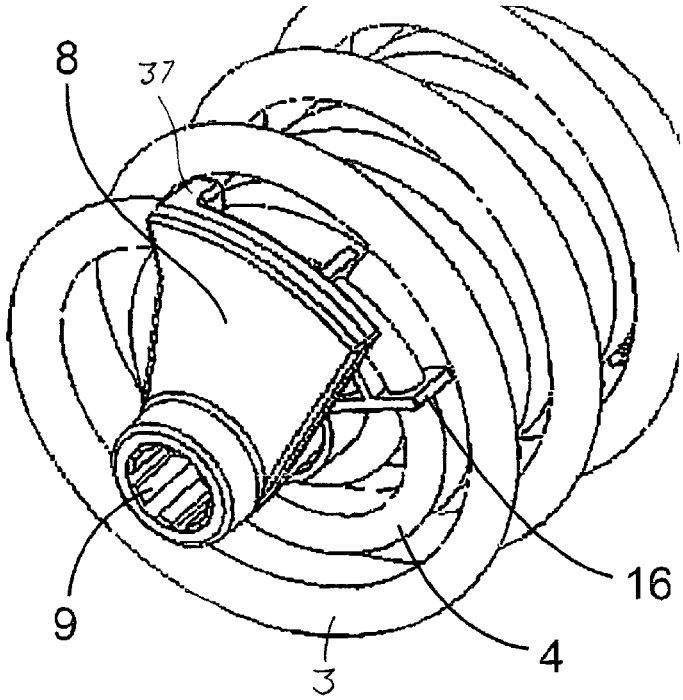
FIG. 6 is a perspective view of the detail in FIG. 5 from another direction.

FIG. 6 illustrates the actuating end fitting 8 of the opening spring 3 from another direction. Also the connection end fitting 16 of the units 4*a* and 4*b* is partly visible there behind.

Figure 7:
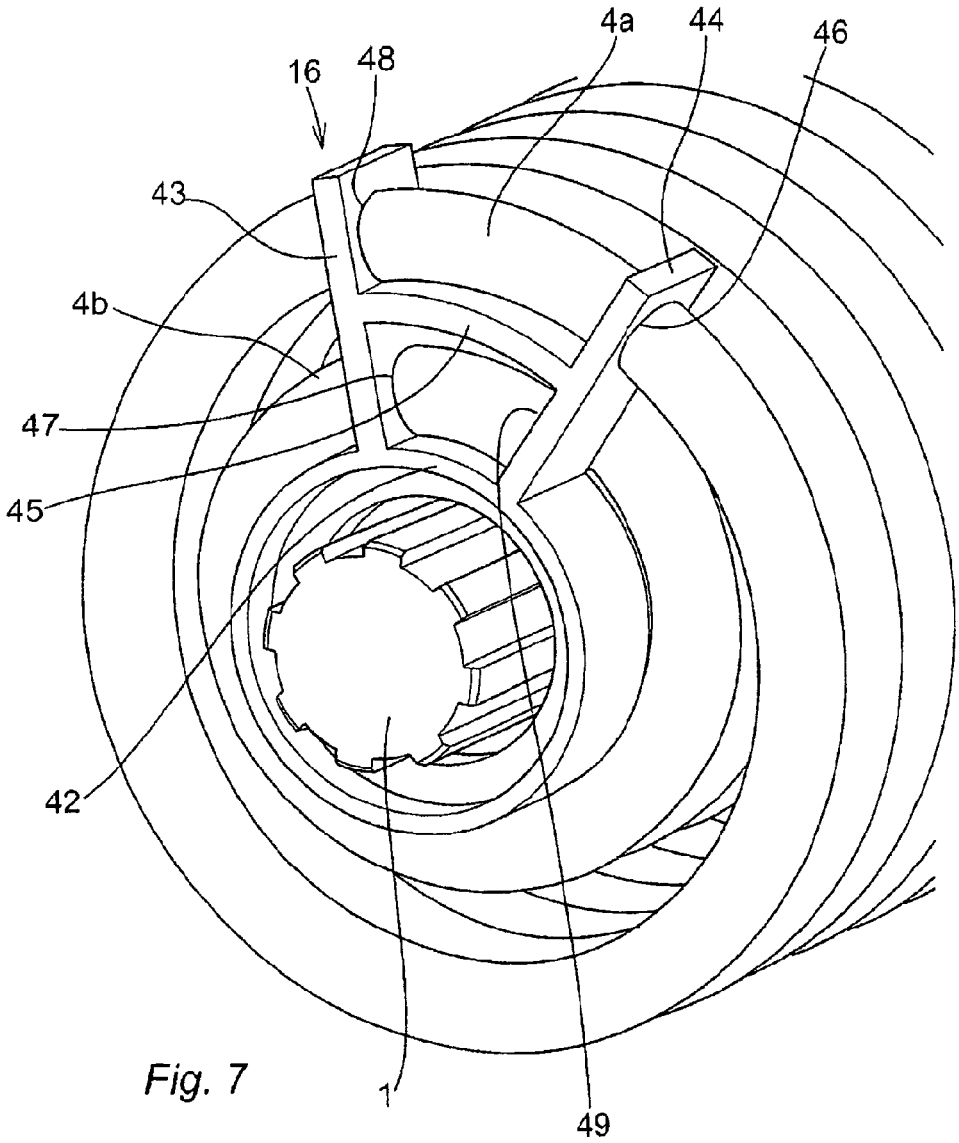
FIG. 7 is a perspective view of a further detail of the spring operated actuator of FIG. 1-6.

FIG. 7 illustrates the connection end fitting 16 more in detail. It consists of an inner ring 42 from which a first 43 and a second 44 abutment flange extend radially outwards at an angular position relative to each other of about 45-60°. At the radial middle of the abutment flanges 43, 44 a circular wall 45 interconnects them, which circular wall is coaxial with the inner ring 42. The first abutment flange 43 has an abutment surface 48 at its radially outer part and a hole 47 through its inner part. Correspondingly the second abutment flange 44 has a hole 46 through its outer part and an abutment surface 49 on its inner part.

The inner closing spring unit 4*b* extends through the hole 47 of the first flange 43, and its end abuts the abutment surface 49 of the second flange 44. Correspondingly the outer closing spring unit 4*a* extends through the hole 46 of the second flange 44, and its end abuts the abutment surface 48 of the first flange 43. A pushing force from the outer closing spring unit 4*a* thereby is transmitted to the inner closing spring unit 4*b*. The end portions of the closing spring units 4*a*, 4*b* are guided against its respective abutment surface 48, 49 by the holes 46, 47, the ring 42 and the circular wall 45. The end portions thereby can be loosely fitted into the connection end fitting 8 and no further attachment means is required.

Figure 8:
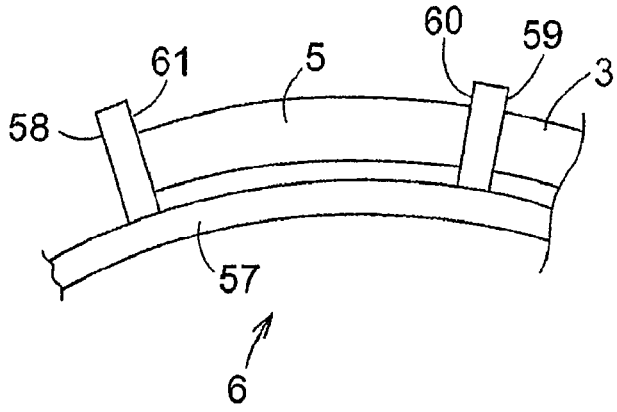
FIG. 8 is a side view of a part of a detail of FIG. 1-4 according to an alternative example.

An alternative construction of the end fittings is illustrated in FIG. 8. In FIG. 8 a part of the supporting end fitting 6 for the opening spring 3 is schematically illustrated. The supported end portion 5 of the opening spring 3 has an end surface against an abutment surface 61 on a radial flange 58 of the end fitting 6. A holding device is formed by a second radial flange 59 and a circumferential part 57 connecting the two flanges 58, 59. The second radial flange 59 has a hole 60 there through and the opening spring extends through this hole 60 such that its end portion 5 is directed towards the abutment surface 61. The other end fittings may have a similar construction.

Figure 9:
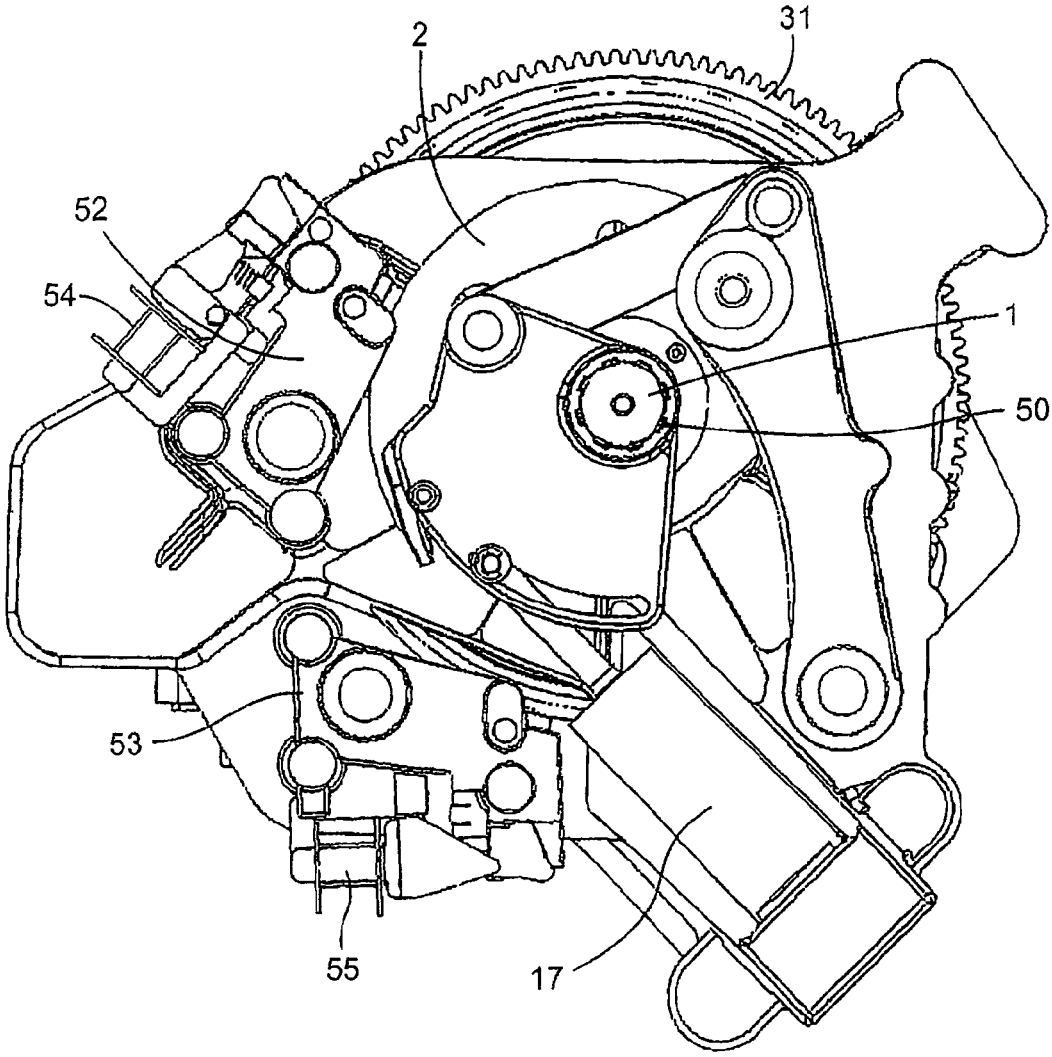
FIG. 9 is an end view of the spring operated actuator as seen from the left of FIG. 1.

FIG. 9 is an end view of the spring operated actuator as seen from the left in FIG. 1. The cam disc 2 is drivingly connected to the main shaft 1 through splines 50. Latch mechanisms 52, 53 with a respective trigging coil 54, 55 control the opening and closing movements of the actuator. In the left part of the figure the oil damper 17 for the opening spring is visible, and to the left a part of the gear wheel 31 for charging the closing spring can be seen.

Figure 10:
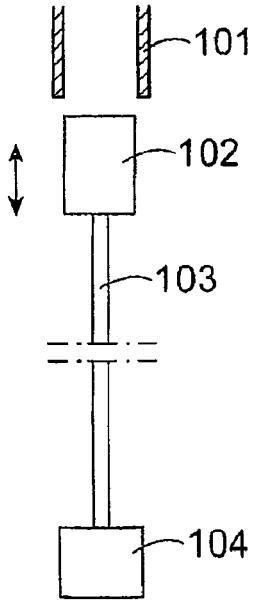
FIG. 10 is a schematic side view of a circuit breaker.

FIG. 10 schematically illustrates a circuit breaker where the movable contact part 102 is brought into and out of contact with the stationary contact part 101 by a rod 103 actuated by a spring operated actuator 104 according to the present invention. For a three phase breaker the actuator 104 can be arranged to simultaneously move the movable contact part 102 of each phase.

What is claimed is:

1. A spring operated actuator for an electrical switching apparatus, the spring operated actuator including closing spring means for closing the switching apparatus, and an opening spring means for opening the switching apparatus, at least one of said spring means including a torsion spring defining a winding direction and an unwinding direction thereof and being arranged to be charged with, to store and to discharge mechanical energy, characterized in that in at least one of said spring means said torsion spring is arranged to be charged with mechanical energy in the unwinding direction and to discharge the mechanical energy in the winding direction.

2. The spring operated actuator according to claim 1 characterized in that both the opening spring means and the closing spring means includes a torsion spring.

3. The spring operated actuator according to claim 2 characterized in that the torsion springs are coaxial.

4. The spring operated actuator according to claim 2 characterized in that the torsion springs are arranged one outside the other and such that at least a major part of the opening torsion spring and at least a major part of the closing torsion spring have the same axial location.

5. The spring operated actuator according to claim 1 characterized in that at least one of said torsion springs is a helical spring.

6. The spring operated actuator according to claim 5 characterized in that the closing torsion spring includes a first torsion spring unit and a second torsion spring unit, which first and second units are coaxial, in that at least a major portion of the first unit and a major portion of the second unit have the same axial location, in that the first unit is located radially outside the second unit and in that the first and second units are connected to each other adjacent one axial end of the closing torsion spring.

7. The spring operated actuator according to claim 6 characterized in that the connection fitting includes a first abutment surface arranged in abutting relationship with an end surface of the first unit and a second abutment surface arranged in abutting relationship with an end surface of the second unit, which first and second abutment surfaces face in the opposite circumferential direction relative to each other.

8. The spring operated actuator according to claim 7 characterized in that the connection fitting includes a first and a second flange extending radially in relation to the spring axis, each flange having said abutment surface for one of said end portions and having a hole for holding the other one of said end portions directed to its abutment surface.

9. The spring operated actuator according to claim 1 characterized in that the opening torsion spring and the closing torsion spring each is a helical spring with an end portion at each end of the respective spring, whereby at least one of said end portions extends along the helix of the spring.

10. The spring operated actuator according to claim 9 characterized in that said at least one end portion extends into an end fitting having an abutment surface arranged in abutting relationship with an end surface of said at least one end portion.

11. The spring operated actuator according to claim 10 characterized in that said end fitting includes a holding device arranged to hold said end portion directed to said abutment surface.

12. The spring operated actuator according to claim 1 characterized in that the electrical switching apparatus is a circuit breaker for medium or high voltage.

13. An electrical switching apparatus characterized in that the switching apparatus includes a spring operated actuator, the spring operated actuator including closing spring means for closing the switching apparatus, and an opening spring means for opening the switching apparatus, at least one of said spring means including a torsion spring defining a winding direction and an unwinding direction thereof and being arranged to be charged with, to store and to discharge mechanical energy, characterized in that in at least one of said spring means said torsion spring is arranged to be charged with mechanical energy in the unwinding direction and to discharge the mechanical energy in the winding direction.

14. The electrical switching apparatus according to claim 13 characterized in that the switching apparatus is a circuit breaker.

15. The electrical switching apparatus according to claim 13 characterized in that the switching apparatus is a medium or a high voltage switching apparatus.

* * * * *